US007757968B2

(12) United States Patent
Bistolfi

(10) Patent No.: US 7,757,968 B2
(45) Date of Patent: Jul. 20, 2010

(54) DISPENSING DEVICE

(75) Inventor: Maurizio Bistolfi, San Giuliano Vecchio (IT)

(73) Assignee: Guala Dispensing S.p.A., Alessandria (IT)

( * ) Notice: Subject to any disclaimer, the term of this patent is extended or adjusted under 35 U.S.C. 154(b) by 801 days.

(21) Appl. No.: 10/902,932

(22) Filed: Aug. 2, 2004

(65) Prior Publication Data

US 2005/0092778 A1 May 5, 2005

(30) Foreign Application Priority Data

Oct. 31, 2003 (EP) ..... 03425708

(51) Int. Cl.
*B65D 37/00* (2006.01)
*B65D 88/54* (2006.01)

(52) U.S. Cl. ..... 239/333; 222/207; 222/383.1; 222/137

(58) Field of Classification Search ..... 222/283.1–385, 222/135–142, 206–215; 239/304, 333
See application file for complete search history.

(56) References Cited

U.S. PATENT DOCUMENTS 3,726,442 A * 4/1973 Davidson et al. ..... 222/207
4,155,487 A * 5/1979 Blake ..... 222/207
4,225,061 A * 9/1980 Blake et al. ..... 222/207
5,152,461 A * 10/1992 Proctor ..... 239/304
5,535,950 A * 7/1996 Barriac et al. ..... 239/304
5,605,257 A * 2/1997 Beard ..... 222/189.09
5,609,299 A * 3/1997 Foster et al. ..... 239/304
5,641,125 A 6/1997 Martin et al.
6,341,717 B2 * 1/2002 Auer ..... 222/135

FOREIGN PATENT DOCUMENTS

DE 19 738 039 A1 8/1997
EP 0 715 899 6/1996
EP 0 751 077 1/1997

* cited by examiner

*Primary Examiner*—Kevin P Shaver
*Assistant Examiner*—Melvin A Cartagena
(74) *Attorney, Agent, or Firm*—Dickstein Shapiro LLP

(57) ABSTRACT

A trigger dispensing device for the concurrent dispensing of two or more fluids separately kept in a tank is disclosed. The dispensing device comprises a deformable elastic membrane whose pumping elements can be affected by a trigger for dispensing fluids. Membrane is held in position between a frame and a counter frame, whereas trigger is hinged to an arm of the counter frame. The device is provided with a delivery valve and with a check valve integrated in the membrane. The device is adapted for the concurrent dispensing of two or more fluids and is provided with a structure comprising a reduced number of components.

30 Claims, 10 Drawing Sheets

DISPENSING DEVICE

FIELD OF THE INVENTION

The object of the present invention is a dispensing device for the concurrent dispensing of two or more fluids separately kept in a tank.

BACKGROUND OF THE INVENTION

In the field of dispensing devices, in particular intended for household purposes, for example dispensing detergent fluids, there is the need of having devices suitable for the concurrent dispensing of two or more fluids kept separately in a tank.

Such need is generally related to the need of combining the two fluids only on the surface to be cleaned, due to the deleterious effects that the combination of such fluids would cause to the structure of the device.

Or, such need is related to the need of keeping the two fluids separate into the tank, for proper storage, combining them upon dispensing or a few seconds before that.

Some dispensing devices known in the field provide for the concurrent dispensing of two fluids kept separate in a tank.

However, such constructions are clearly derived from a simple coupling of two dispensing devices, each suitable for dispensing a single fluid, actuated by a single trigger.

An embodiment according to the description above is shown, for example, in document EP0715899.

There is therefore the need of having a dispensing device for the concurrent dispensing of two or more fluids kept separately in a tank which should be designed for such precise purpose and which should therefore provide for a limited number of components and an optimum operation.

SUMMARY OF THE INVENTION

Object of the present invention is that of providing to the realisation of a dispensing device which should meet the above requirements and at the same time overcome the disadvantages mentioned above with reference to the prior art.

The problem at the basis of the present invention is solved by a dispensing device according to claim 1. The dependent claims describe variants of embodiments.

BRIEF DESCRIPTION OF THE DRAWINGS

The features and the advantages of the dispensing device according to the present invention will appear more clearly from the following exemplificative and non-limiting description, made with reference to the attached figures, wherein.

DETAILED DESCRIPTION OF THE INVENTION

Figures 1, 2A, 2B:
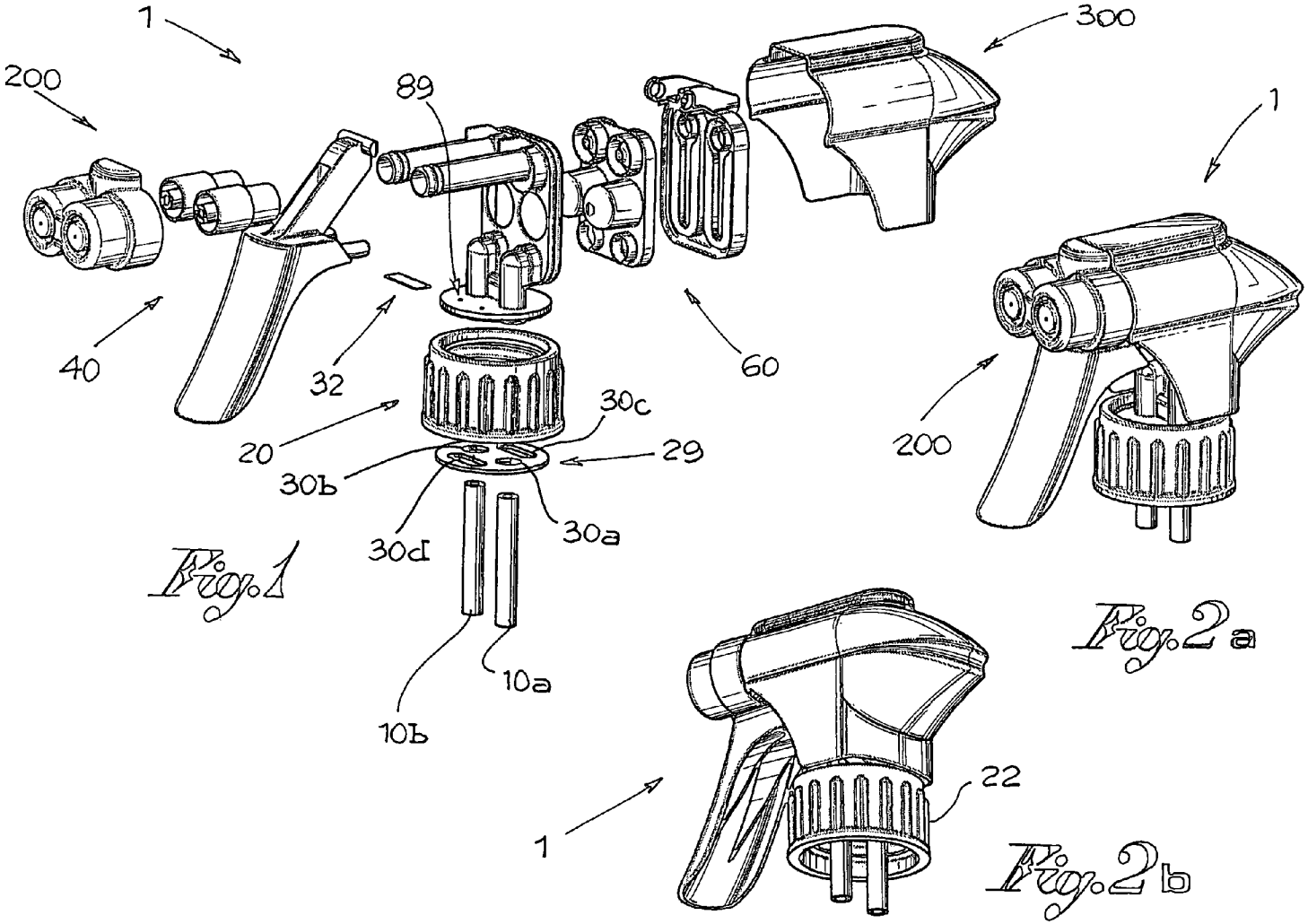
FIG. 1 shows an axonometric view with separate parts of a dispensing device according to an embodiment.
FIGS. 2*a* and 2*b* show axonometric views of the dispensing device.

With reference to FIGS. 1, 2*a*, 2*b* and 3*a*-3*c*, reference numeral 1 generally indicates a dispensing device according to a variant of embodiment.

The dispensing device 1 is associable to a tank (not shown) adapted for the separate containment of a first fluid and a second fluid. Preferably, said tank comprises at least two containment chambers, respectively adapted for the containment of said fluids.

In a preferred embodiment, device 1 is fluidically associable to said tank by a first feeding pipe 10*a* and a second feeding pipe 10*b*, respectively in fluidic communication with said first containment chamber and said second containment chamber of the tank.

The dispensing device 1 is mechanically associable to said tank by closing means 20.

The dispensing device 1 comprises actuating means 40 suitable for the actuation of said device for the concurrent dispensing of the first and of the second fluid.

Moreover, said device comprises pumping means 60, adapted for sucking said fluids from the tank and dispensing towards an environment outside the device, for example a surface to be cleaned.

The dispensing device 1 further comprises swirling means 200, adapted for imparting a desired swirling to said first and second fluid, for example in order to better spread on the surface to be cleaned or to better mix on it or in a mixing chamber.

Moreover, the dispensing device 1 comprises covering means 300, adapted for covering said pumping means 60 and/or for improving the device's grip by the user.

Figure 4:
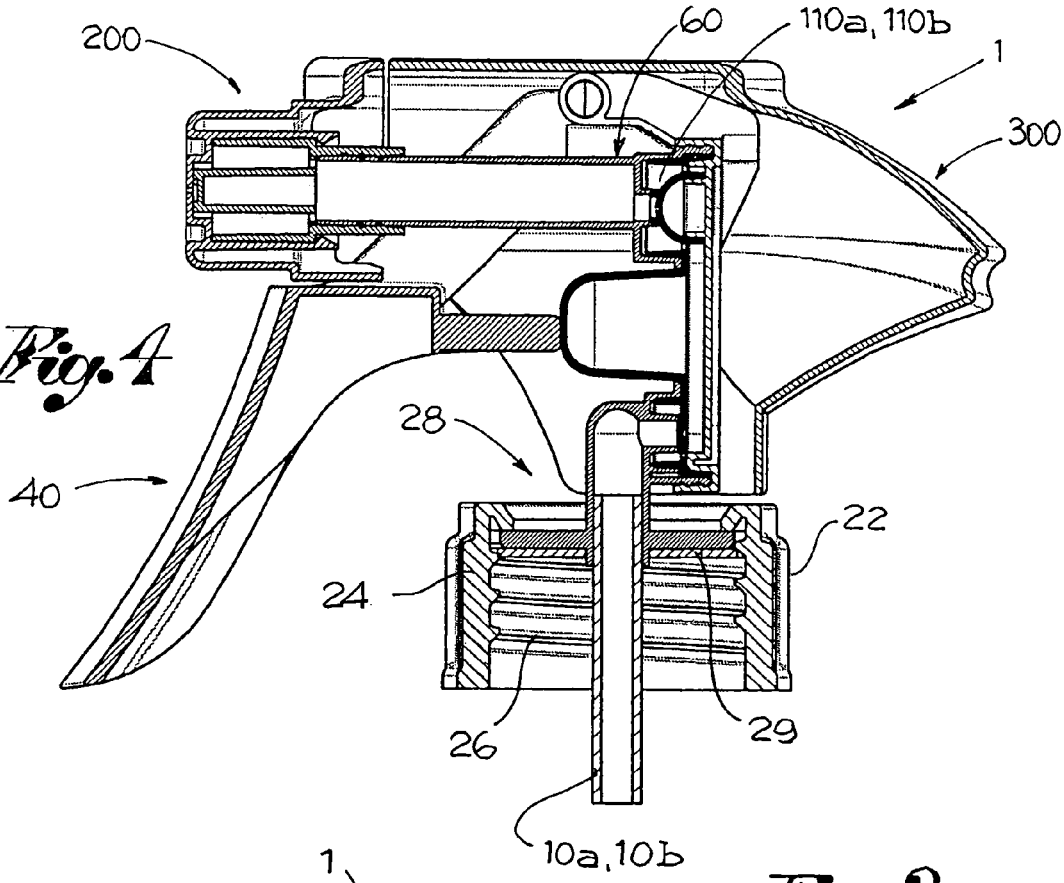
FIG. 4 shows a section view of the dispensing device according to the section line IV-IV in FIG. 3*c;*
Figure 3A:
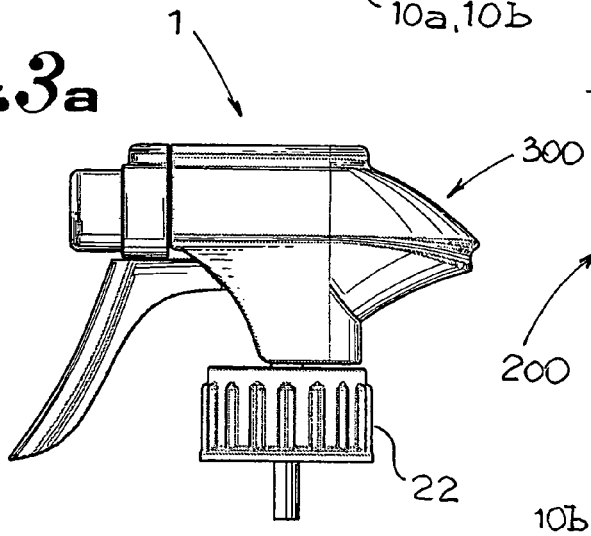
FIGS. 3*a*-3*c* respectively show a front, a side and a plan view of the dispensing device.
Figure 3B:
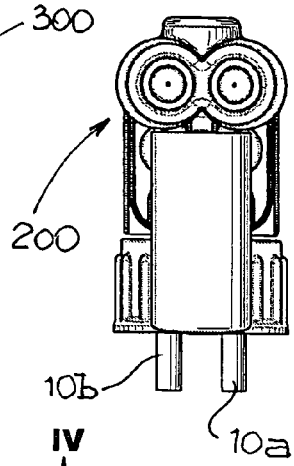
Figure 3C:
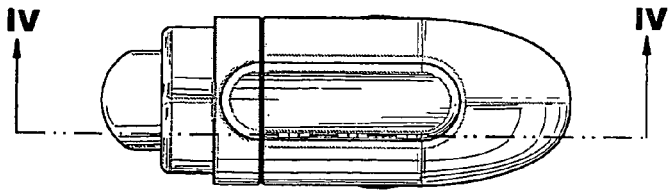

In a preferred embodiment, the closing means 20 comprises a closure 22 realised by an annular wall 24 having a preferably knurled outside surface, in order to help the grip of closure 22 by the user (FIG. 4). Internally, closure 22 exhibits a threaded portion 26 for connecting closure 22 to the tank.

At the side opposed to said threaded portion 26, closure 22 exhibits means for connecting device 1 to closure 22, for example comprising a snap mechanism 28. Moreover, said closing means 20 comprises a circular plate 29, preferably made of foamed material, associable to closure 22, for example at the threaded portion 26, substantially having a sealing function between closure 22 and the containment chambers of said fluids.

The circular plate 29 exhibits a first thorough opening 30*a* and a second thorough opening 30*b*, respectively provided for inserting the first pipe 10*a* and the second pipe 10*b*.

Said circular plate 29 further comprises through openings 30*c*, 30*d*, each in fluid communication with the fluid containment chambers.

According to a preferred embodiment, the dispensing device comprises a venting membrane 32, permeable to gases and impermeable to fluids, preferably a Gore® membrane.

Figure 5A:
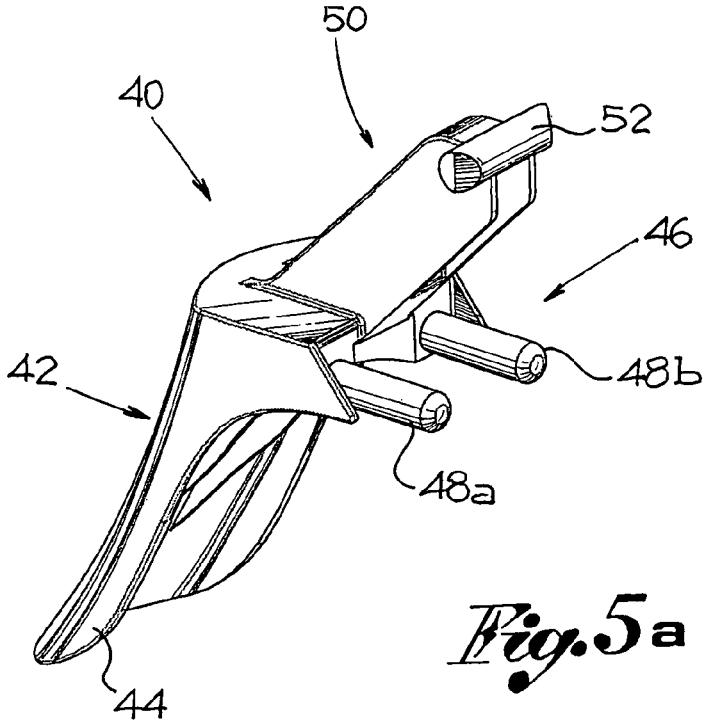
FIGS. 5*a* and 5*b* show axonometric views of a trigger of the dispensing device.
Figure 5B:
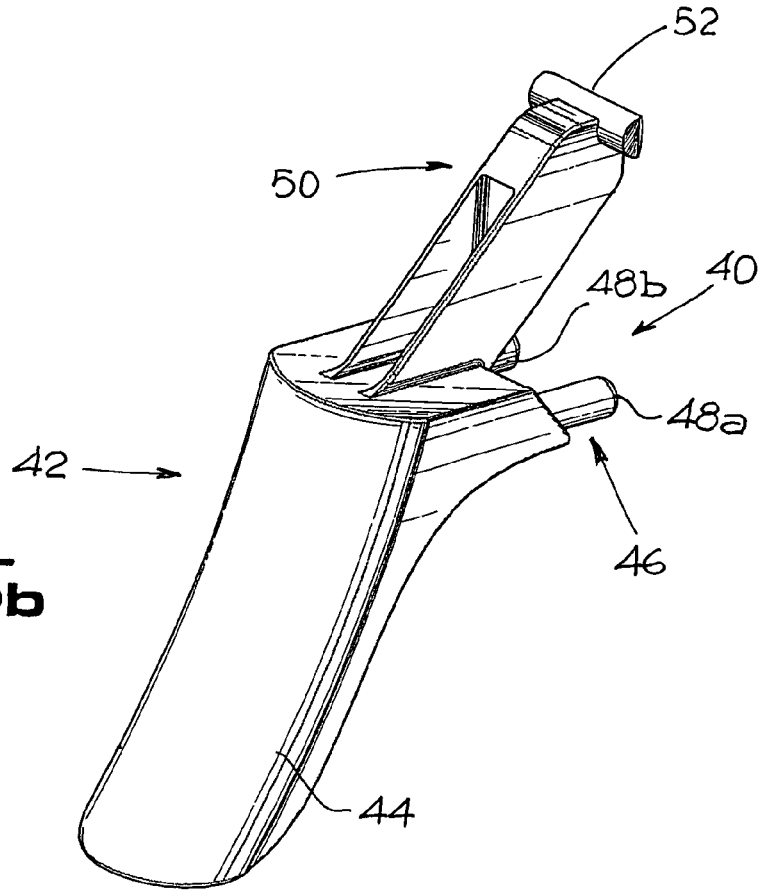

In a preferred embodiment, the actuating means 40 comprises a trigger 42, that is an element, generally elongated, hingeable and affectable by the user's hand fingers, for actuating the dispensing device 1 (FIGS. 5*a*, 5*b*).

Preferably, trigger 42 comprises a handling portion 44, upon which the user acts, and an actuation portion 46, operatively associable to the pumping means 60 of device 1 for fluid dispensing.

In a preferred embodiment, said actuation portion 46 comprises a first actuation pin 48*a* and a second actuation pin 48*b*, projecting from said handling portion 44.

Moreover, in an embodiment, trigger 42 comprises an arm 50, projecting from said handling portion 44, carrying an hinging pin 52 at a free end of said arm. Preferably, said arm 50 projects from said handling portion 44 at least partly overhanging said actuation portion 46.

Figure 6A:
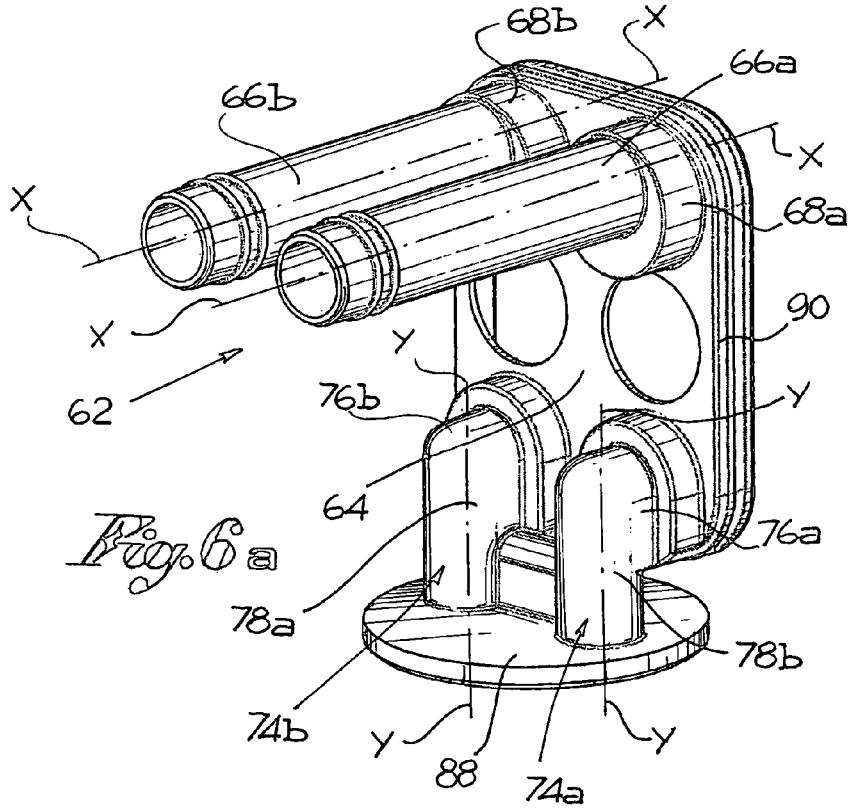
FIGS. 6*a* and 6*b* show axonometric views of a frame of the dispensing device.
Figure 6B:
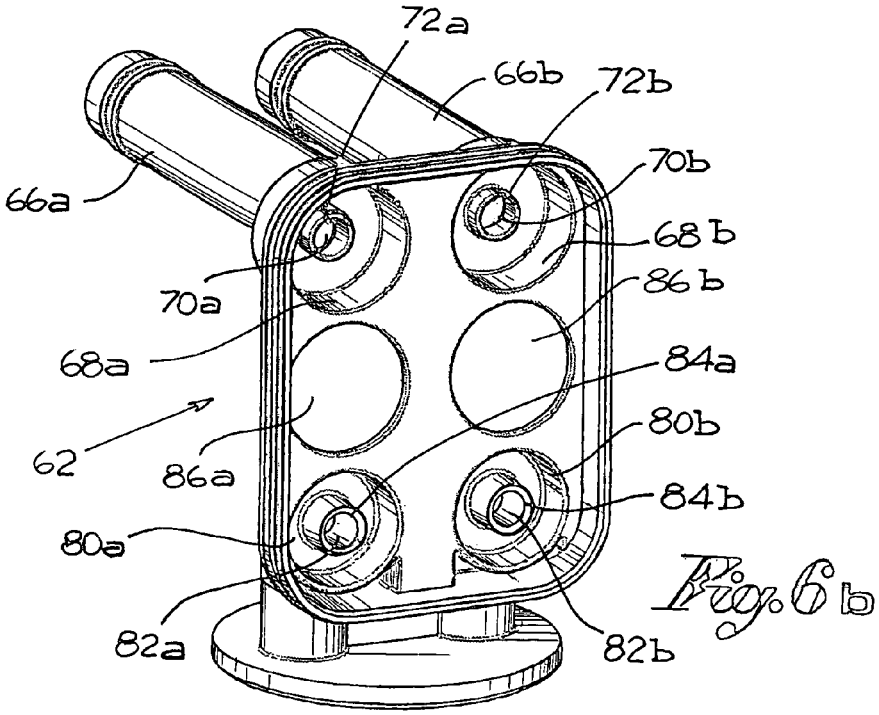

In a preferred embodiment, the pumping means 60 of device 1 comprises a frame 62, preferably made in a single piece (FIGS. 6*a*, 6*b*).

Preferably, frame 62 comprises a frame plate 64, generally rectangular, from which a first tubular delivery element 66*a* and a second tubular delivery element 66*b* protrude, which respectively develop along a dispensing axis X-X.

Preferably, said dispensing axis X-X is perpendicular to the frame plate 64.

At the union between said tubular elements 66*a*, 66*b*, frame 62 exhibits respective delivery chambers 68*a*, 68*b*. Each tubular delivery element 66*a*, 66*b* is in fluid communication with the respective delivery chamber 68*a*, 68*b* by a respective delivery opening 70*a*, 70*b*.

Each delivery opening 70*a*, 70*b*, is surrounded, in said delivery chamber 68*a*, 68*b*, by a respective annular wall of delivery opening 72*a*, 72*b*.

Moreover, said frame 62 comprises a first tubular intake element 74*a* and a second tubular intake element 74*b*.

Said tubular intake elements respectively exhibit an elbow portion 76*a*, 76*b* connected to an end intake portion 78*a*, 78*b*.

Said end intake portions 78*a*, 78*b* develop along an intake axis Y-Y, preferably perpendicular to said dispensing axis X-X.

At the union between said tubular intake elements 74*a*, 74*b* with the frame plate 64, there are preferably arranged intake chambers 80*a*, 80*b*.

Said tubular intake elements 74*a*, 74*b* are in fluid communication with said intake chambers 80*a*, 80*b* by respective intake chamber openings 82*a*, 82*b*.

Said intake chamber openings 82*a*, 82*b* are surrounded in said intake chambers 80*a*, 80*b* by respective annular walls of intake chamber openings 84*a*, 84*b*.

Between said tubular delivery elements 66*a*, 66*b* and said tubular intake elements 74*a*, 74*b* frame 62 exhibits a first insertion opening 86*a* and a second insertion opening 86*b*, passing through the frame plate 64.

Moreover, frame 62 comprises a connecting plate 88, arranged at the free end of said tubular intake elements 74*a*, 74*b*.

In a preferred embodiment, said connecting plate exhibits at least one venting opening 89, passing through said plate.

Preferably, moreover, said frame comprises a connecting wall 90 that protrudes from the frame plate 64, along its edge, from a side opposed to said tubular delivery elements 66*a*, 66*b*.

Figure 7A:
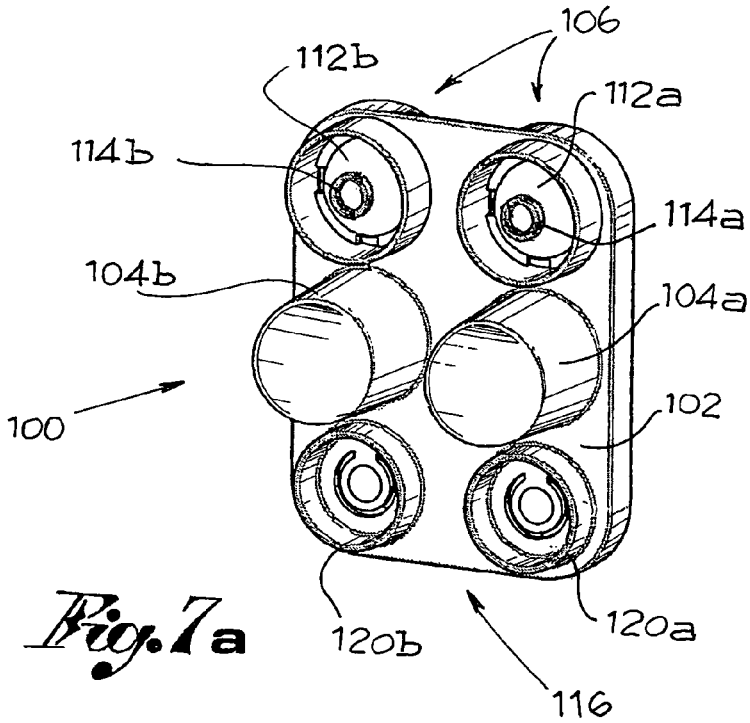
FIGS. 7*a* and 7*b* show axonometric views of a membrane of the dispensing device.
Figure 7B:
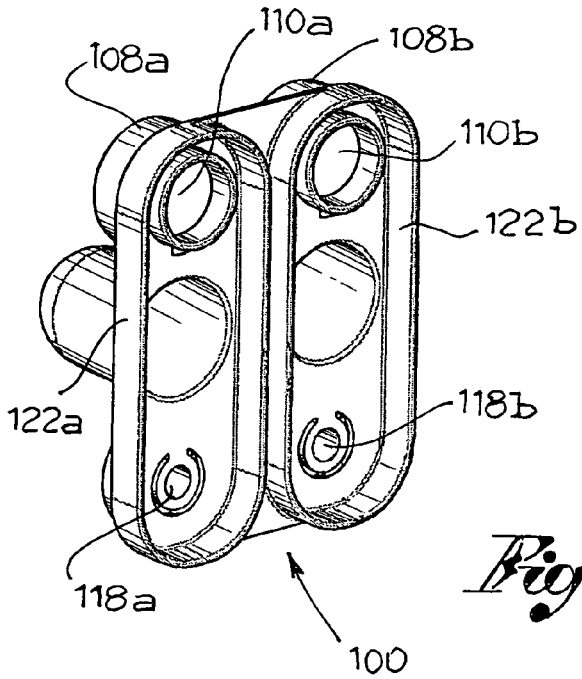

The pumping means 60 further comprises a membrane 100, preferably made in a single piece (FIGS. 7*a*, 7*b*). Membrane 100 comprises a membrane plate 102 from which a first pumping element 104*a* and a second pumping element 104*b* protrude, realised by elements preferably shaped as truncated cones and hollow.

In a variant of embodiment, the pumping means 60 further comprises valve delivery means 106, adapted for preventing the reflow of the first and of the second dispensed fluid.

Preferably, said valve delivery means 106 respectively comprises for the first and the second fluid, an annular wall of delivery means 108*a*, 108*b* that surround respective openings of delivery means 110*a*, 110*b* of the membrane plate 102 of membrane 100.

Moreover, said delivery means 106 comprises respective cap elements 112*a*, 112*b*, provided, according to a preferred embodiment, with a ring 114*a*, 114*b* arranged on top of said cap elements.

In a preferred embodiment, the dispensing device 1 further comprises check valve means 116, adapted for preventing the reflow of the first and of the second fluid sucked towards the tank.

Preferably, said check valve means 116 respectively comprises a lip 118*a*, 118*b* of the membrane plate 102.

Preferably, respective notches of the membrane plate 102 realise in said plate said lips 118*a*, 118*b*.

The pumping elements 104*a*, 104*b* of membrane 100 are arranged in intermediate position between said valve delivery means 106 and said check valve means 116.

Membrane 100 further comprises an annular membrane wall 120 that protrudes from the membrane plate 102, along its edge and from a side opposed to pumping elements.

Preferably moreover, membrane 100 exhibits respective partitions 122*a*, 122*b*, protruding from the membrane plate 102 from a side opposed to said pumping elements 104*a*, 104*b*.

The first partition 122*a* surrounds a group consisting of the first pumping element 104*a*, of the first opening of the valve delivery means 110*a* and of the first lip 118*a* of the check valve means.

Correspondingly, the second partition 122*b* surrounds a group consisting of the second pumping element 104*b*, of the second opening of the valve delivery means 110*b* and of the second lip 118*b* of the check valve means.

Figure 8A:
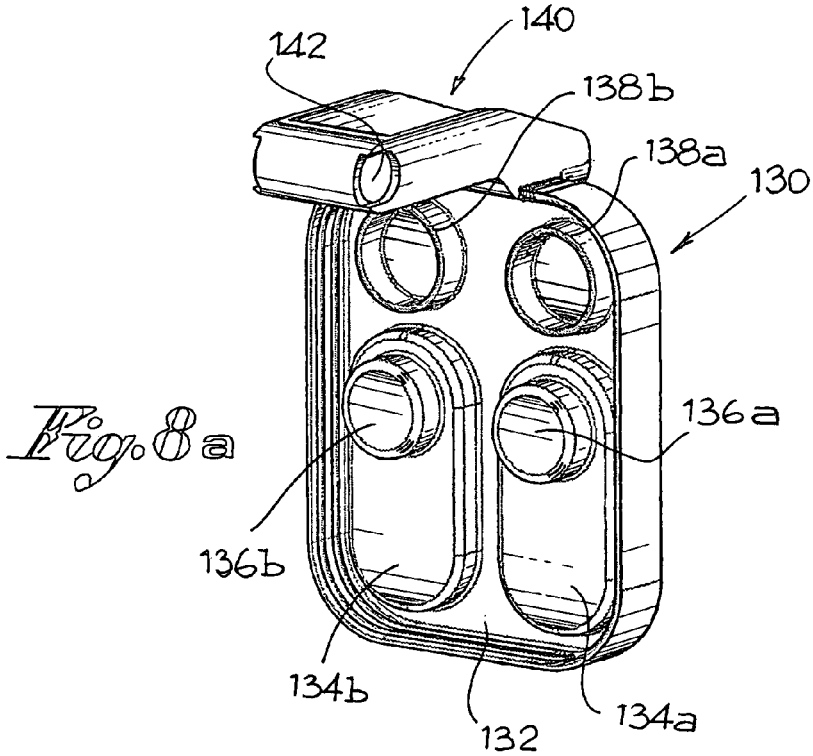
FIGS. 8*a* and 8*b* show axonometric views of a counter frame of the dispensing device.
Figure 8B:
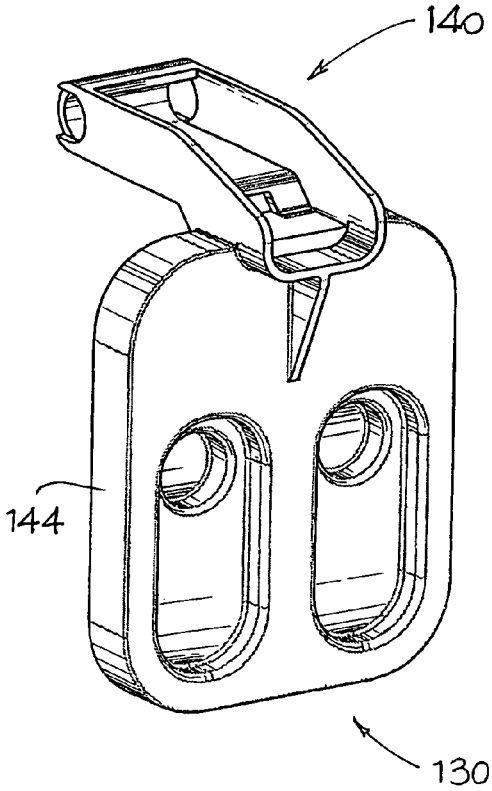
Figure 9A:
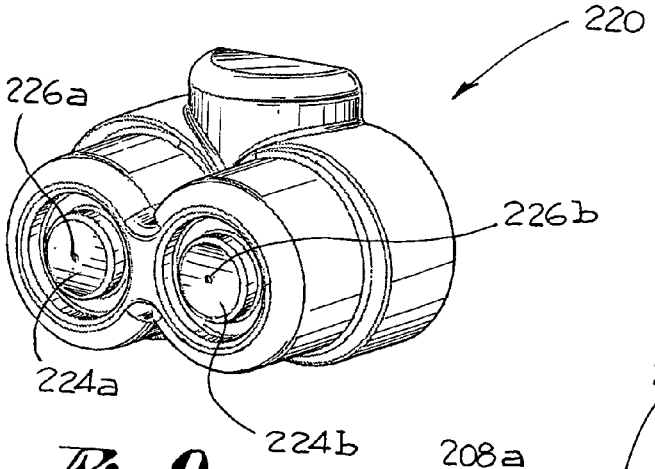
FIGS. 9*a* and 9*b* show axonometric views of a mask of swirling means of the dispensing device.
Figure 10A:
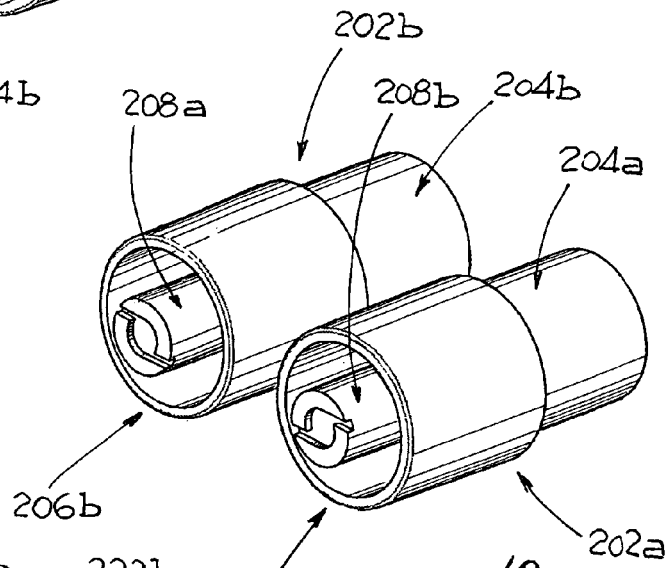
FIGS. 10*a* and 10*b* show axonometric views of tubular swirling elements of the swirling means of the dispensing device.
Figure 9B:
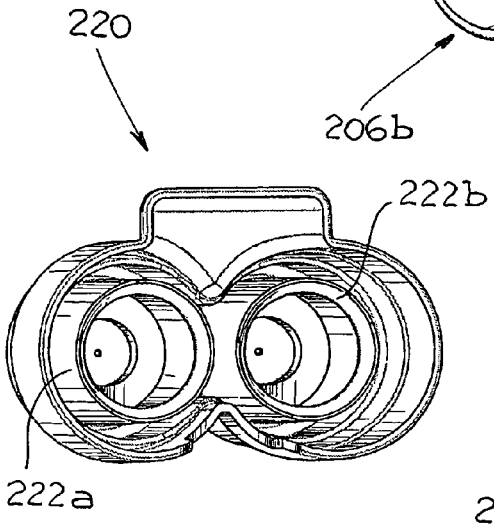
Figure 10B:
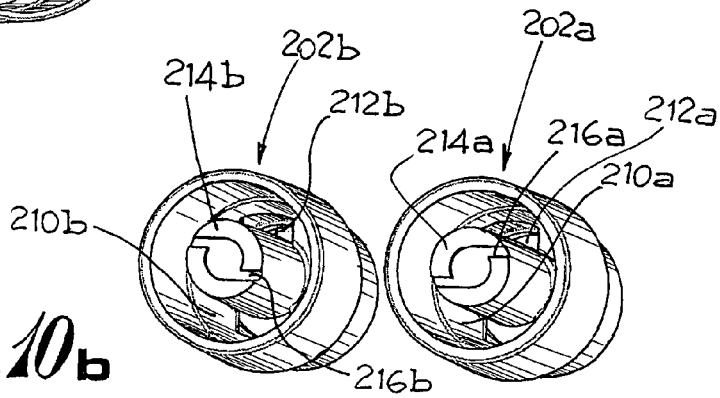
Figure 13:
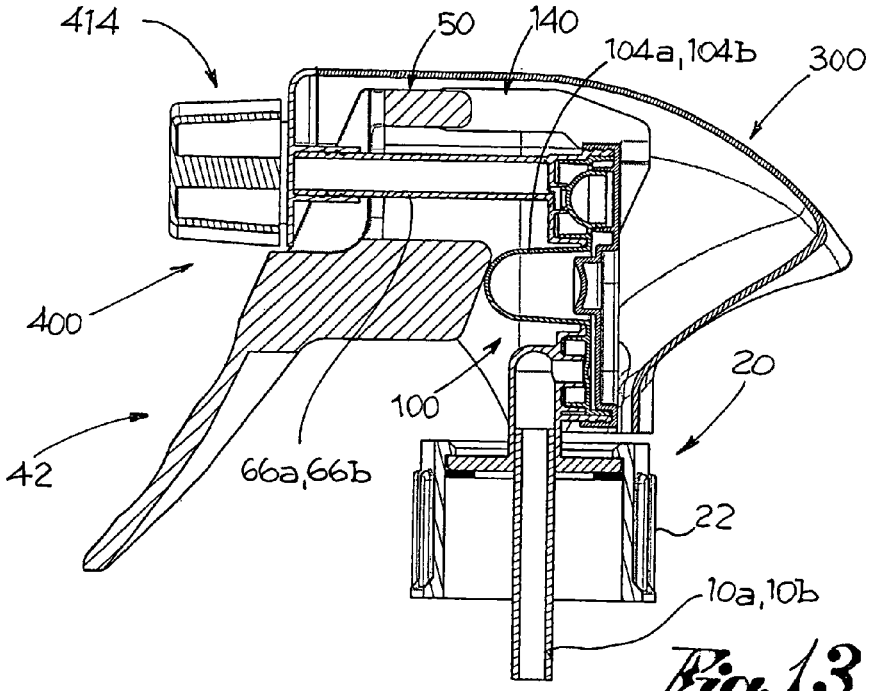
FIG. 13 shows a section view of the dispensing device of FIG. 12.
Figure 11:
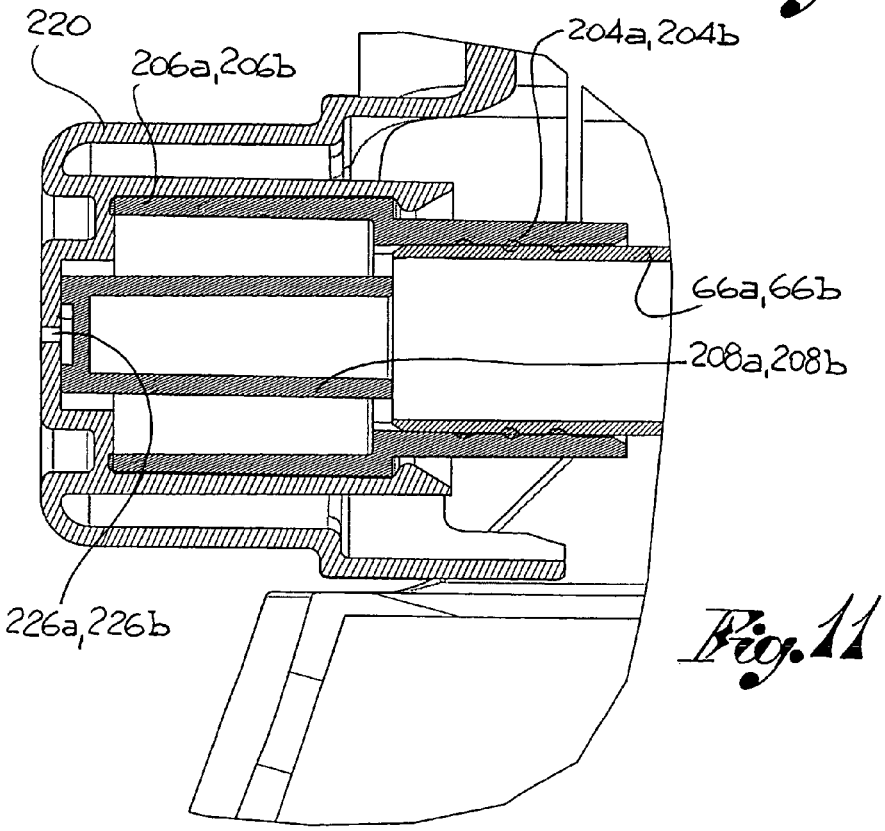
FIG. 11 shows a section detail of the swirling means.
Figure 12:
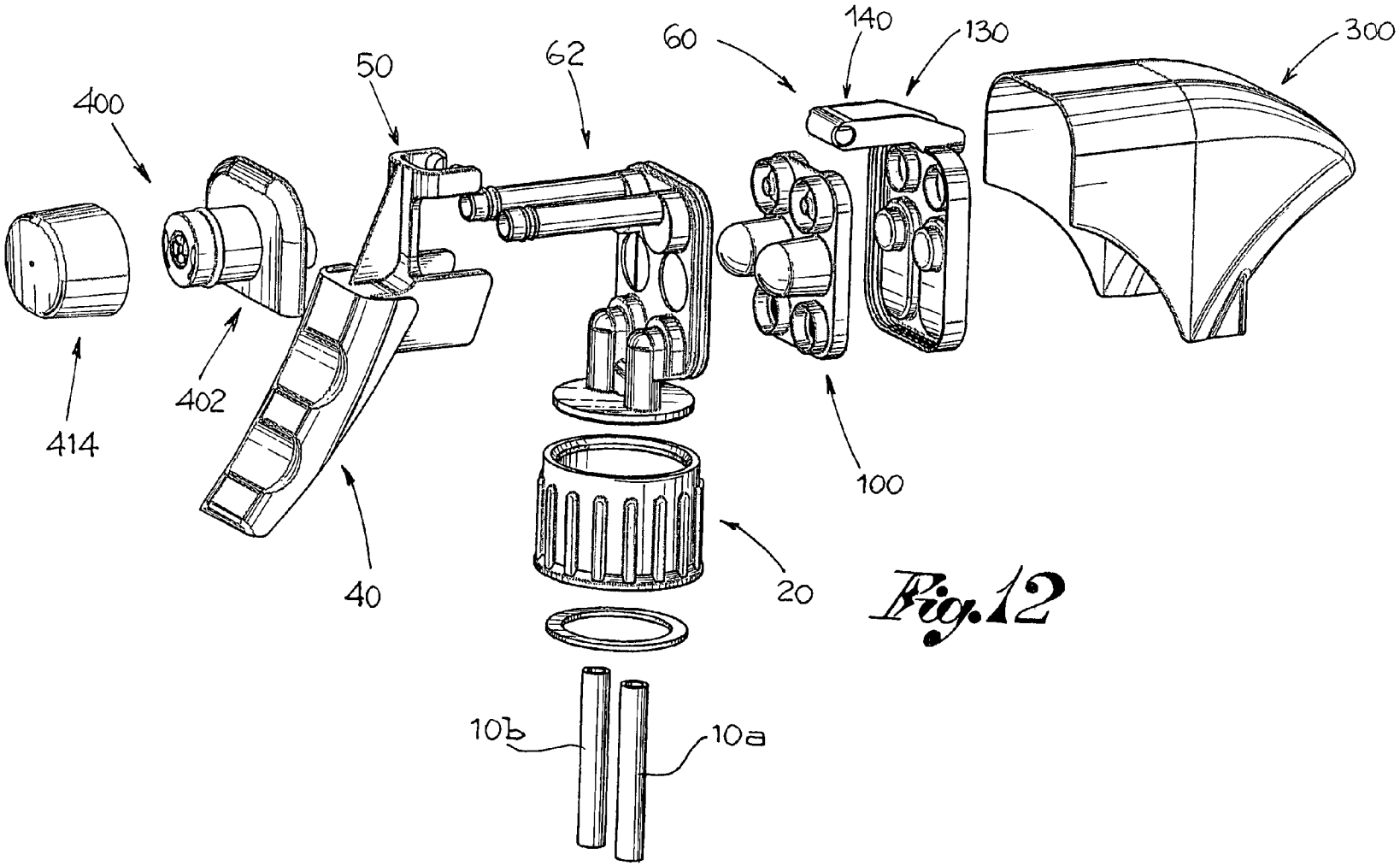
FIG. 12 shows an axonometric view with separate parts of the dispensing device according to a further embodiment.
Figure 14B:
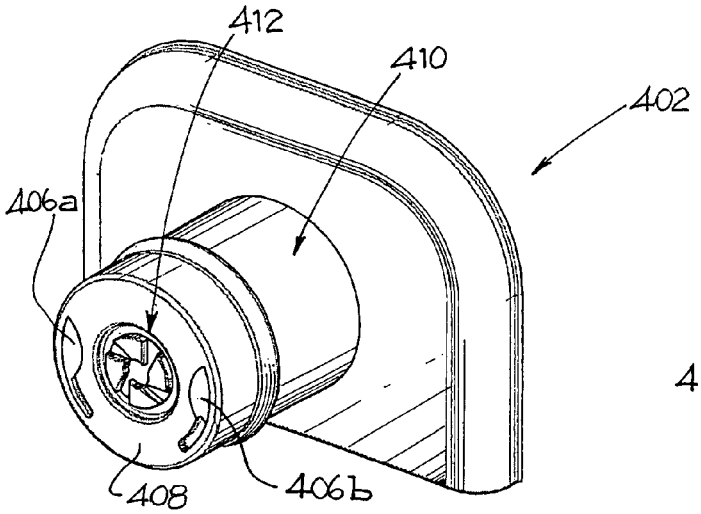
FIGS. 14*a* and 14*b* show axonometric views of the swirling means of a further variant of embodiment.
Figure 15A:
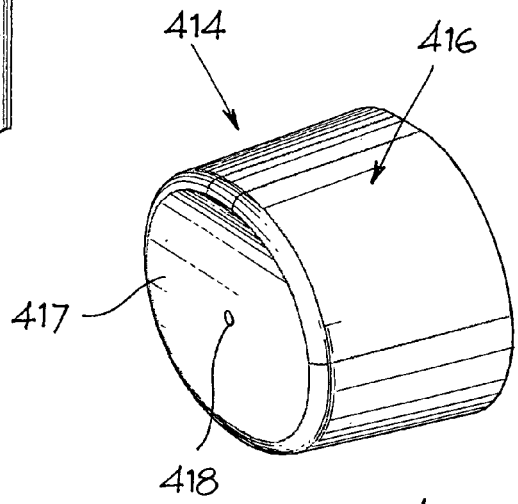
FIGS. 15*a* and 15*b* show axonometric views of a mask of the swirling means of FIGS. 14*a* and 14*b*.
Figure 14A:
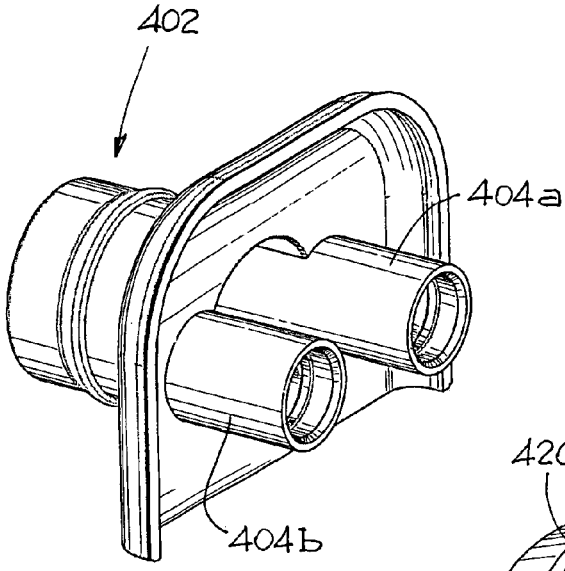
Figure 15B:
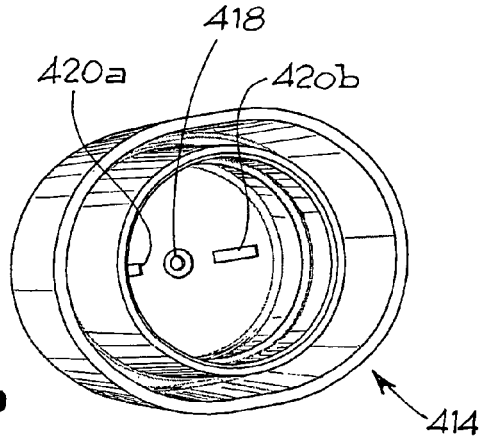

According to a preferred embodiment, the pumping means 60 further comprises a counter frame 130, preferably made in a single piece (FIGS. 8*a*, 8*b*).

The counter frame 130 comprises a counter frame plate 132 from which, in an embodiment, respective projections 134*a*, 134*b*, arranged sided and separate, protrude.

According to a variant of embodiment, each of said projections 134*a*, 134*b* exhibits a projection 136*a*, 136*b*, preferably protruding from said projection.

The counter frame 130 further comprises respective annular counter frame walls 138*a*, 138*b*, protruding from the same side as said projections 134*a*, 134*b*.

According to a preferred embodiment, a counter frame arm 140 protrudes from said counter frame plate 132, which at a free end exhibits a hinge seat 142.

Preferably, said counter frame arm 140 projects from said counter frame plate 132 from the same side as said projections 134*a*, 134*b*.

Moreover, counter frame 130 exhibits an annular counter frame wall 144, projecting from said counter frame plate 132 from the same side as said projections 134*a*, 134*b*.

According to a preferred embodiment, the swirling means 200 comprises a first tubular swirling element 202*a* and a second tubular swirling element 202*b* (FIGS. 9*a*, 9*b*, 10*a*, 10*b* and 11).

Each tubular swirling element 202*a*, 202*b* comprises a connecting portion 204*a*, 204*b* and an active portion 206*a*, 206*b*.

Said active portion 206*a*, 206*b* exhibits an inside arm 208*a*, 208*b* integral with the respective connecting portion 204*a*, 204*b* by a swirling plate 210*a*, 210*b*, provided with arm openings 212*a*, 212*b*.

At the free end, each inside arm 208*a*, 208*b* exhibits at least one swirling projection 214*a*, 214*b*.

Said swirling projections are preferably arranged circumferentially at the free end of the swirling arm, spaced out by swirling notches 216*a*, 216*b*.

Moreover, said swirling means 200 comprises a mask 220 provided with connecting walls 222*a*, 222*b* to said tubular swirling elements 202*a*, 202*b*.

Moreover, said mask 220 exhibits respective swirling walls 224*a*, 224*b*, each provided with a dispensing opening 226*a*, 226*b*.

In an assembled configuration of the dispensing device 1, the first pipe 10*a* and the second pipe 10*b* are respectively inserted in the first thorough opening 30*a* and in the second thorough opening 30*b* of the circular plate 29 of the closing means 20.

Said plate is arranged inside said closure 22, preferably at the end of the threaded portion 26, adjacent the snap mechanism 28.

The venting membrane 32 is made integral with frame 62, preferably at the surface of the connecting plate 88 of frame 62 that faces the interior of the containment chambers.

Preferably, said venting membrane 32 is welded to the connecting plate 88 so as to cover the venting openings 89 presents in said plate.

Frame 62 of the pumping means 60 is arranged on the circular plate 29, so that the connecting plate 88 of said frame is connected to closure 22 by the snap mechanism 28.

The first pipe 10*a* is in fluid communication with the first tubular intake element 74*a* and the second pipe 10*b* is in fluid communication with the second tubular intake element 74*b*.

Membrane 100 of the pumping means 60 is associated to frame 62.

In particular, the membrane plate 102 is adapted for being coupled to the frame plate 64 and surrounded by the connecting wall 90 projecting from said frame plate 64.

The pumping elements 104*a*, 104*b* are respectively inserted into the insertion openings 86*a*, 86*b* of the frame plate 64.

Correspondingly, the annular walls of the valve delivery means 108*a*, 108*b* of membrane 100 couple with the respective delivery chambers 68*a*, 68*b* of frame 62.

In particular, said coupling makes rings 114*a*, 114*b* of the cap elements 112*a*, 112*b* introduce into the respective delivery openings 70*a*, 70*b*, insisting on the respective annular delivery opening walls 72*a*, 72*b*.

Correspondingly, the annular walls of the check valve means 120*a*, 120*b* couple with the respective intake chambers 80*a*, 80*b*.

In particular, each lip 118*a*, 118*b* of membrane 100 couples with the respective intake opening 82*a*, 82*b*, abutting against the respective intake opening wall 84*a*, 84*b*.

The counter frame 130 is adapted for associating to frame 62 so that membrane 100 appears as an intermediate element blocked between said frame and said counter frame.

In particular, the connecting wall 90 of the frame plate 64 couples with the annular wall of the counter frame plate 144, for example with a snap connection.

Projections 134*a*, 134*b* of the counter frame 130 are arranged at the check valve means, whereas the respective projections 136*a*, 136*b* penetrate, at least partly, into the volume defined by the pumping elements 104*a*, 104*b*.

Partitions 122*a*, 122*b* of membrane 100, coupled with the membrane plate 102, with the pumping elements 104*a*, 104*b* and with the counter frame plate 132, define a first pumping chamber and a second pumping chamber, separate from one another.

In particular, said first pumping chamber and said second pumping chamber are separate because said flow partitions after assembly insert between projections 134*a*, 134*b* of the counter frame 130.

Said pumping chambers respectively are in fluid communication through a duct called intake duct, with the first containment chamber and the second containment chamber of the tank.

Preferably, said intake ducts comprise said tubular intake elements 74*a*, 74*b* of frame 62 and said pipes 10*a*, 10*b*.

Between said pumping chambers and said containment chambers, along said intake ducts, there are provided said check valve means 116.

Moreover, said pumping chambers respectively are in fluid communication through a duct, called delivery duct, with the exterior of the dispensing device.

Between said pumping chambers and said environment outside the dispensing device 1, along said dispensing ducts, there are provided said valve delivery means 106.

In particular, the cap elements 112*a*, 112*b* of said valve delivery means 106 are respectively inserted into the annular counter frame walls 138*a*, 138*b* of said counter frame.

The counter frame arm 140, protruding from the counter frame plate 132, is adapted for hinging trigger 42 of the actuation means 40.

In particular, the hinging pin 52, carried by arm 50 of trigger 42, is operatively coupled with the hinge seat 142 of the counter frame arm 140, realising a hinge for said trigger.

After assembly, the actuation means 40 is arranged in suitable position for affecting the pumping means for fluid dispensing.

In particular, said actuation pins 48*a*, 48*b* of the actuation portion 46 of trigger 42, can abut against the respective pumping elements 104*a*, 104*b* of the pumping means 60.

The free end of the tubular delivery elements 66*a*, 66*b* of frame 62 is associated to the respective tubular swirling elements 202*a*, 202*b*.

In particular, the connecting portion 204*a*, 204*b* of said tubular swirling elements associate to said free ends, for example by a snap connection.

Preferably, said tubular delivery elements are moved in abutment with their free end with the swirling plates 210*a*, 210*b* of said swirling means.

Said tubular delivery elements 66*a*, 66*b* remain in fluid communication with the exterior of the dispensing device thanks to the openings of arm 212*a*, 212*b* provided on each swirling plate 210*a*, 210*b*.

Mask 220 of the swirling means 200 is adapted for being associated to said tubular swirling elements 202*a*, 202*b*.

Preferably, the connecting walls 222*a*, 222*b* of said mask 220 are coupled the active portion 206*a*, 206*b* of the tubular swirling elements 202*a*, 202*b*.

The swirling walls 224*a*, 224*b* of mask 220 abut against the swirling projections 214*a*, 214*b* of the inside arms 208*a*, 208*b*.

The volume comprised between the inside arm 208*a*, 208*b*, the active portion 206*a*, 206*b* and the swirling plate 210*a*, 210*b* of the tubular swirling element 202*a*, 202*b* and the swirling wall 224*a*, 224*b* of mask 220 defines an intermediate chamber.

The volume comprised between the free end of the inside arm 208*a*, 208*b*, the swirling projections 214*a*, 214*b* of the tubular swirling element 202*a*, 202*b* and the swirling wall 224*a*, 224*b* of mask 220 defines an end swirling chamber.

Said intermediate chamber and said end swirling chamber are in fluid communication by notches 216*a*, 216*b* of the inside arms 208*a*, 208*b*.

In other words, the delivery duct between the pumping chambers and the outside environment comprises a swirling duct, said swirling duct comprising an intermediate chamber and an end swirling chamber, in fluid communication with the outside environment through a dispensing opening 226*a*, 226*b* of mask 220.

Cover 300 is associated to said dispensing device for covering at least partly said pumping means and/or for facilitating an ergonomic grip of the device by the user.

In a first operating configuration, the dispensing device is in a rest configuration wherein the pumping elements 104*a*, 104*b* are in a non-deformed configuration, that is, in a configuration wherein the pumping chambers exhibit a maximum volume.

In the normal use of the dispensing device 1, the user grips said device, for example arranging the rear side of cover 300 in contact with the hand's palm and the fingers on the handling portion 44 of trigger 42.

The valve delivery means 106 and the check valve means 116 are in a closed configuration.

By actuating trigger 2, hinged, its actuation portion 46 affects the pumping elements 104*a*, 104*b* at the same time, deforming them.

In other words, said pumping chambers shift from the maximum volume to a volume smaller than the maximum volume, for example a minimum volume, corresponding to the maximum rotation of trigger 42.

The first and the second fluid, separately held in the first pumping chamber and in the second pumping chamber, through the action of the trigger and the deformation of the pumping elements, generate a thrust that moves the valve delivery means in an open configuration, whereas the check valve means are forced into a closed configuration.

In other words, the thrust of the fluids acts on the cap elements 112*a*, 112*b* of the valve delivery means, making them collapse.

In particular, ring 114*a*, 114*b* of said annular cap elements moves away from the delivery opening 68*a*, 68*b* of frame 62, placing said pumping chambers in fluid communication with the outside.

The first and the second fluid flow through the dispensing duct to the outside, preferably flowing also through said swirling duct.

In the swirling duct, said fluids are separately subject to swirling through the passage through notches 216*a*, 216*b* of the inside arms 208*a*, 208*b*.

The fluids are therefore separately dispensed, for example on a surface to be cleaned.

At the same time, the thrust to which the fluids held in the pumping chambers are subject pushes lips 118*a*, 118*b* of the check valve means against the intake openings 82*a*, 82*b* of the intake chambers 80*a*, 80*b*, preventing the reflow of said fluids towards the tank containment chambers.

By releasing trigger 42, the pumping elements 104*a*, 104*b*, that exhibit elastic properties, return to the non-deformed condition.

Said elastic return of the pumping elements causes a whirlpool action inside the pumping chambers which brings the valve delivery means back to a closed condition wherein the cap elements 112*a*, 112*b* close the delivery openings 70*a*, 70*b*.

In other words, the pumping chambers are not in fluid communication with the outside environment, since the dispensing duct is cut out.

At the same time, said whirlpool action moves lips 118*a*, 118*b* of the check valve means away from the intake openings 82*a*, 82*b*, placing the pumping chambers in fluid communication with the fluid containment chambers.

Through said pipes 10*a*, 10*b*, the first and the second fluid are sucked by the respective containment chambers of the tank to the respective pumping chambers of the dispensing device 1.

When the pumping chambers are restored to the normal volume, the whirlpool action stops and dispensing device returns to the rest configuration.

It is clear that when the device is first used, it is necessary to repeatedly press trigger 42 to fill the pumping chambers with the fluids coming from the containment chambers.

The venting membrane 32, the venting openings 89 and openings 30*c*, 30*d* of the circular plate 29 made of a foamed material are a preferred example of the venting means, adapted for allowing the gas venting from the containment chambers to the outside of the device.

In particular, said venting means allow degassing the containment chambers following the possible production of undesired gases released by said fluids, as well as a passive venting.

During operation, the trigger action on the pumping elements is opposed by the structure of the dispensing device 1 which provides for membrane 100 arranged in intermediate position between frame 62 and counter frame 130.

Said trigger action is opposed by the connection between said frame and said counter frame and at the same time, by the connection between the counter frame and the trigger itself.

In other words, the action of trigger 42 tends to make membrane 100 come out of frame 62. This action is opposed by the connection between frame and counter frame and at the same time, the connection of the counter frame arm 140 with the trigger itself.

Said counter frame arm-trigger connection pushes the counter frame towards the frame and thereby membrane 100 towards the latter.

Frame 62, during the operation of the device, keeps membrane 100 into position so that the action of trigger 42 on the pumping elements 104*a*, 104*b* is effective.

At the same time, it exhibits both the tubular intake elements 74*a*, 74*b*, and the tubular delivery elements 66*a*, 66*b*.

Said elements, that respectively realise intake ducts and delivery ducts, develop along directions incident with one another, preferably orthogonal.

Membrane 100, made of a deformable elastic material, exhibits both the pumping elements 104*a*, 104*b*, and the check and delivery valve means and the partitions for realising separate pumping chambers for the first and the second fluid.

In a further embodiment of the dispensing device 1, the fluids are separately held in the respective containment chambers of tank 1 and dispensed separately in a mixing chamber wherein they are mixed before they are delivered outwards (FIGS. 12, 13, 14*a*, 14*b*, 15*a*, 15*b*).

Hereinafter, reference shall be made only to the peculiar features of the above embodiment, references to same components being the same as the description above.

In said embodiment, the dispensing device 1 comprises swirling means 400 comprising a mixing element 402 provided with tubular connecting elements 404*a*, 404*b* adapted for associating with the free end of the tubular delivery elements 66*a*, 66*b* of frame 62.

Said tubular connecting means exhibit, at a side opposed to the connecting end with said tubular delivery means 66*a*, 66*b*, respective ejection openings 406*a*, 406*b*, preferably obtained in the front wall 408 of a lining element 410.

Said front wall 408 further comprises one or more swirling projections 412 separate from one another and preferably arranged circumferentially.

In a preferred embodiment, said projections 412 are flush with the surface of the front wall 408.

Preferably, said ejection openings are arranged on said front wall 410 radially externally with respect to said swirling projections 412.

The swirling means 400 further comprises a mask 414 provided with a blanket 416 adapted for being fitted on said lining element 410, and a swirling wall 417 provided with at least one dispensing opening 418.

Moreover, said mask 414 exhibits, in a preferred embodiment, at least one notch realised inside the swirling wall 417, having substantially radial extension relative to said mask.

Preferably, said swirling wall 417 exhibits a pair of notches 420*a*, 420*b* realised inside the swirling wall 417.

The front wall 410, the swirling projections 412, a portion of blanket 416 and the swirling wall 417 delimit a swirling chamber that exhibits the ejection openings 406*a*, 406*b* that allow the fluid communication with the tubular delivery elements 66*a*, 66*b*, and the dispensing opening 418 that allows the fluid communication with the outside environment.

The fluids to be dispensed, separately, are pushed, during the dispensing step, inside the tubular connecting elements 404*a*, 404*b*, from which they exit into the swirling chamber.

Into said chamber, the fluids mix both freely and by action of the swirling realised by the projections of the front wall.

From the swirling chamber, the mixed fluid is dispensed out of the dispensing device.

Notches 420*a*, 420*b* realised into the swirling wall 417 and the front wall 408 of the mixing element 402 form a preferred example of means for opening/closing device 1.

In a first operating configuration of said means, mask 414 is in a first open position, wherein notches 420*a*, 420*b* are overlapped, at least partly, to openings 406*a*, 406*b* of the mixing element 402.

In said position, openings 406*a*, 406*b* are in fluid communication with projections 412 by said notches 420*a*, 420*b*, so the fluids come out.

In a second operating configuration of said means, mask 414 is in a second closed position, wherein notches 420*a*, 420*b* are not overlapped to openings 406*a*, 406*b* of the mixing element 402.

In said position, openings 406*a*, 406*b* are not in fluid communication with projections 412, so fluid dispensing is prevented.

Unusually, the dispensing device for two or more fluids separately kept in a tank according to the present invention exhibits a reduced number of components.

In other words, the dispensing device according to the present invention exhibits components each having multiple functions, so as to reduce the number of necessary components.

Advantageously, the membrane is made of a deformable elastic material and realises means for changing the volume of the pumping chambers, elastic return means and, coupled with the counter frame, it delimits said pumping chambers.

At the same time, said membrane integrates check and delivery valve means.

Advantageously, moreover, the frame comprises the tubular delivery and intake elements and effectively supports the membrane for opposing the trigger action on the pumping elements.

A further advantages is that the device is provided with intake and delivery ducts having extension along incident directions, preferably perpendicular, in order to allow an easy assembly and convenient use of the trigger.

According to a further advantageous aspect, the membrane is held between the frame and the counter frame, the latter being connected to the trigger and being pushed towards the membrane during dispensing.

According to a further advantageous aspect, in the assembly of the dispensing device, the frame, the membrane and the counter frame can be coupled in a sequence according to a single coupling direction that overlaps them.

Advantageously, the assembly of device 1 is quick and accurate.

It is clear that a man skilled in the art will be capable of making several changes and variants to the dispensing device according to the present invention, all falling within the scope of protection as defined by the following claims.

What is claimed is:

1. A dispensing device configured to interface with a tank along a first axis, the device being adapted for dispensing a first fluid and a second fluid separately held respectively in a first containment chamber and a second containment chamber of the tank, the device comprising:

actuating means comprising a trigger and adapted for being actuated by fingers of a user for the concurrent dispensing of the fluids; and pumping means adapted for sucking and dispensing the fluids, wherein the pumping means comprises:

a first and a second pumping chamber, separate from one another, respectively fluidically associated to an intake duct and a dispensing duct, the pumping chambers exhibiting, in a rest configuration of the device, a maximum volume and in a dispensing configuration, a reduced volume, lower than the maximum volume, wherein the pumping chambers are at least partly delimited by deformable elastic walls, deformable by the actuating means along a second axis from the rest configuration to the dispensing configuration, wherein the deformable elastic walls are held in position by a counter frame of the pumping means, wherein the counter frame is directly connected to the trigger for opposing the trigger action on the deformable elastic walls, wherein the deformable elastic walls form a gap with a depression in the counter frame for fluidic association of the pumping chambers with the intake duct and the dispensing duct, and wherein the first axis and the second axis are substantially perpendicular.

2. A device according to claim 1, wherein the pumping means comprises a deformable elastic membrane comprising the deformable elastic walls.

3. A device according to claim 2, wherein the membrane comprises valve delivery means arranged along the delivery duct.

4. A device according to claim 3, wherein the valve delivery means comprises cap elements.

5. A device according to claim 2, wherein the membrane comprises check valve means arranged along the intake duct.

6. A device according to claim 5, wherein the check valve means comprises lips obtained in the membrane.

7. A device according to claim 1, wherein the counter frame is made of a stiffer material than the material of the deformable elastic walls.

8. A device according to claim 1, wherein the counter frame comprises tubular delivery elements and tubular intake elements.

9. A device according to claim 1, wherein the counter frame comprises a counter frame arm for the operating connection with the actuating means.

10. A device according to claim 1, wherein the trigger exhibits a handling portion from which an arm extends, adapted for hinging the trigger with the pumping means.

11. A device according to claim 1, wherein the pumping chambers are defined by the coupling of a membrane comprising the deformable walls with the counter frame.

12. A device according to claim 11, wherein the membrane further comprises partitions that abut against a counter frame plate of the counter frame for separating the pumping chambers.

13. A device according to claim 1, wherein the pumping means can be covered by a covering adapted for realizing a resting wall for the hand's palm of a user.

14. A device according to claim 1, further comprising swirling means adapted for imparting a desired swirling to the fluids before they are dispensed.

15. A device according to claim 14, wherein the swirling means comprises a first tubular swirling element and a second separate tubular swirling element, associable to a mask having a first dispensing opening and a second dispensing opening.

16. A device according to claim 15, wherein the swirling means comprises a first tubular connecting element and a second tubular connecting element, in fluid connection with a single mixing chamber.

17. A device according to claim 16, wherein the mixing chamber exhibits at least one dispensing opening for dispensing the first and the second mixed fluids.

18. A device according to claim 1, further comprising venting means adapted for allowing the venting of gas contained into the containment chambers.

19. A device according to claim 18, wherein the venting means comprises a gas permeable and fluid impermeable membrane.

20. A device according to claim 1, comprising means for opening and closing the dispensing device.

21. A device according to claim 1, wherein the intake ducts and the dispensing ducts extend along incident directions.

22. The dispensing device of claim 1, wherein the gap between the deformable elastic walls and the depression in the counter frame comprises two fluidic channels configured to separately convey the first and second fluids.

23. A dispensing device, comprising:

a tank comprising first and second fluid storage chambers each configured to separately hold a respective fluid;

a trigger comprising first and second actuators; and a pump comprising:

first and second pumping chambers each at least partially defined by a respective deformable elastic wall;

a counter frame, directly and pivotally connected to the trigger, for opposing a force exerted by the first and second actuators on the deformable elastic walls, wherein a gap between the deformable elastic walls and a depression in the counter frame forms a fluid conduit and wherein the trigger and pump are coupled to the tank by an annular wall configured to interface with the tank along an axis perpendicular to the axis along which the first and second actuators exert a force on the deformable elastic walls.

24. The dispensing device of claim 23, further comprising a frame coupled to the counter frame, wherein the pumping chambers are held in position between the frame and the counter frame.

25. The dispensing device of claim 24, wherein the first and second pumping chambers extend through respective holes in the frame.

26. The dispensing device of claim 23, wherein depressing the trigger causes the first and second actuators to deform the deformable elastic walls and reduce the volume of the first and second pumping chambers.

27. The dispensing device of claim 23, wherein the deformable elastic walls are formed of one elastic membrane.

28. The dispensing device of claim 23, wherein the fluid conduit comprises two discrete channels for separately conveying fluids from the first and second fluid storage chambers.

29. A dispensing device configured to interface with a tank along a first axis, the device being adapted for dispensing a first fluid and a second fluid separately held respectively in a first containment chamber and a second containment chamber of the tank, the device comprising:

actuating means comprising a trigger and adapted for being actuated by fingers of a user for the concurrent dispensing of the fluids; and pumping means adapted for sucking and dispensing the fluids, the pumping means comprising a membrane, the membrane comprising:

separate deformable elastic walls forming first and second pumping chambers, respectively fluidically associated to an intake duct and a dispensing duct, the pumping chambers exhibiting, in a rest configuration of the device, a maximum volume and in a dispensing configuration, a reduced volume, lower than the maximum volume; and a membrane plate from which each elastic wall protrudes longitudinally along a second axis;

wherein the deformable elastic walls are held in position by a counter frame of the pumping means, wherein the counter frame is operatively connected to the trigger for opposing the trigger action on the deformable elastic walls, wherein the deformable elastic walls form a gap with a depression in the counter frame for fluidic association of the pumping chambers with the intake duct and the dispensing duct, and wherein the first axis and second axis are substantially perpendicular.

30. The dispensing device of claim 29, wherein the gap comprises fluid channels for transporting the first and second fluids from the intake duct to the dispensing duct such that the first and second fluids do not mix within the gap.

* * * * *